US007257914B2

(12) United States Patent
Sauer

(10) Patent No.: US 7,257,914 B2
(45) Date of Patent: Aug. 21, 2007

(54) DISPLAY SYSTEM

(75) Inventor: Jason Sauer, Sugar Hill, GA (US)

(73) Assignee: Hitachi Koki USA Ltd., Norcross, GA (US)

( * ) Notice: Subject to any disclaimer, the term of this patent is extended or adjusted under 35 U.S.C. 154(b) by 0 days.

(21) Appl. No.: 10/961,226

(22) Filed: Oct. 12, 2004

(65) Prior Publication Data

US 2006/0075668 A1 Apr. 13, 2006

(51) Int. Cl.
*G09F 13/18* (2006.01)

(52) U.S. Cl. ..... 40/546; 40/124.02; 40/547

(58) Field of Classification Search ..... 40/124.02, 40/541, 546, 547; 362/600–634, 551–583
See application file for complete search history.

(56) References Cited

U.S. PATENT DOCUMENTS

| | | | | |
|---|---|---|---|---|
| 3,208,174 | A * | 9/1965 | Wrenshall | 40/546 |
| 3,226,865 | A | 1/1966 | Brand | |
| 3,578,538 | A | 5/1971 | Prosser et al. | |
| 4,860,475 | A * | 8/1989 | Levy et al. | 40/547 |
| 5,103,581 | A * | 4/1992 | Novak | 40/547 |
| 5,124,890 | A | 6/1992 | Choi et al. | |
| 5,232,388 | A * | 8/1993 | Danjell | 445/22 |
| 5,249,969 | A | 10/1993 | Confalone, Jr. et al. | |
| 5,295,596 | A | 3/1994 | Squitieri | |
| 5,368,489 | A | 11/1994 | Confalone, Jr. et al. | |
| 5,444,930 | A | 8/1995 | Loew | |
| 5,479,276 | A * | 12/1995 | Herbermann | 349/5 |
| 5,521,799 | A | 5/1996 | VerKamp | |
| 5,536,558 | A | 7/1996 | Shelton | |
| 5,572,818 | A | 11/1996 | Churchill | |
| 5,704,145 | A | 1/1998 | Hanitz | |
| 5,751,386 | A | 5/1998 | Kanda et al. | |
| 5,921,011 | A | 7/1999 | Hawyer | |
| 5,956,854 | A | 9/1999 | Lorocco | |
| 6,297,424 | B1 | 10/2001 | Olson et al. | |
| 6,308,444 | B1 | 10/2001 | Ki | |
| 6,637,924 | B2 | 10/2003 | Pelka et al. | |
| 6,662,483 | B2 | 12/2003 | Reynolds | |
| 6,791,637 | B2 * | 9/2004 | Klein | 349/62 |

FOREIGN PATENT DOCUMENTS

| | | | |
|---|---|---|---|
| DE | 3812418 A | * | 10/1989 |
| JP | 03249610 A | * | 11/1991 |

OTHER PUBLICATIONS

Cyro Industries, Promotional/Catalog Pages, www.cyro.com, 2000, 2 pages, Cyro Industries, Rockaway, NJ.

Cyro Industries, "New Dazzling ACRYLITE® Radiant Acrylic Sheet Adds New Dimensions to P-O-P Displays," http://www.cyro.com/Internet/SiteContent.nsf/WebMSDSs/3EF8BC1A029105A485256D630068C99D/?OpenDocument, Jun. 19, 2003, Cyro Industries, Rockaway, NY.

* cited by examiner

*Primary Examiner*—Cassandra Davis
(74) *Attorney, Agent, or Firm*—Hunton & Williams

(57) ABSTRACT

A point-of-purchase display having a display board with a front surface and a rear surface. A graphical element, having an illuminated element, is disposed on the front surface, and an optical waveguide is positioned to be visible through an opening in the board to provide an illuminated pattern corresponding with the illuminated element.

10 Claims, 3 Drawing Sheets

DISPLAY SYSTEM

FIELD OF THE INVENTION

This invention pertains generally to point-of-purchase displays, and more specifically to displays representing laser tools. In one embodiment, the invention achieves the effect and appearance of a laser beam guideline without requiring an extra light source or power supply.

DESCRIPTION OF RELATED ART

Advertising displays, such as point-of-purchase displays, are commonly used in retail environments to attract the attention of consumers and to induce them to buy the displayed product. Point-of-purchase displays are typically placed in a store, often directly adjacent to the product advertised, such as on a shelf or in an aisle, and have a callout feature which draws the attention of a consumer. The callout feature typically identifies an important feature that distinguishes the product advertised from other competing products, or other features that are not readily apparent when viewing the product. One way of making this product and/or feature stand out is by illuminating the display. However, illuminated displays having their own light sources have several disadvantages, such as heat generation, the need for an external power source, bulk, and burn-out of the light source. Alternatively, one may use a non-illuminated display containing bright or fluorescent colored artwork, but this technique lacks the visual impact of an illuminated display.

In certain displays, such as those depicting products that incorporate laser beams, projected laser beams, headlights, light-emitting diodes, or other light emitting or illuminated surfaces, illumination is useful not only for its attention-getting quality, but also for better illustrating the function of the light source. A non-illuminated sign for this purpose is particularly undesirable and much less effective. For Example, many tools incorporate lasers for aligning parts, marking a line, or sensing the presence of another object. Some power tools, especially miter saws, use lasers to assist the user in placing a precise cut. However, it has been a problem to design a point-of-purchase display that clearly conveys the concept of a laser beam or laser beam guideline to the consumer, without resorting to expensive illuminated displays or less effective non-illuminated displays.

Various attempts been made to create a display that gives the visual impression of being illuminated, by using only ambient light. For example, U.S. Pat. No. 3,226,865 to Brand, incorporated herein by reference, describes a sign structure that is formed by a transparent sheet with a layer of an opaque material (such as paint) on the back side. The back side of the sheet is then engraved, forming symbol recesses (such as lettering). The engraving cuts away the opaque material, making the recesses transparent. A reflective member is placed behind the layered sign material, which acts to reflect ambient light and illuminate the transparent recesses. U.S. Pat. No. 5,536,558 to Shelton, also incorporated herein by reference, describes a sign having a translucent fluorescent plastic material, such as a fluorescent acrylic sheet, as a conduit to capture ambient light. There are grooves formed in one surface of the acrylic sheet which refract the ambient light collected in the sheet, producing a visual effect similar to an electrically illuminated sign, such as neon tube signs.

SUMMARY OF THE INVENTION

An embodiment of the present invention provides a point-of-purchase display that is capable of portraying an illuminated item by using ambient light and without requiring the use of electrical power. In accordance with this embodiment of the invention, a display board is provided with front and rear surfaces, at least one graphical element that depicts an illuminated item, an opening in the display board, and a waveguide that projects light through the opening. The opening corresponds to the illuminated item of the graphical element. The waveguide collects ambient light and concentrates it through the opening in the display board. The waveguide is preferably placed generally in the rear of the display board so that only its illuminated edges appear through the openings in the board. The waveguide is preferably an acrylic sheet. In one preferred embodiment, the item depicted by the display is a power tool that utilizes a laser beam guideline.

DETAILED DESCRIPTION OF PREFERRED EMBODIMENTS

Figure 1:
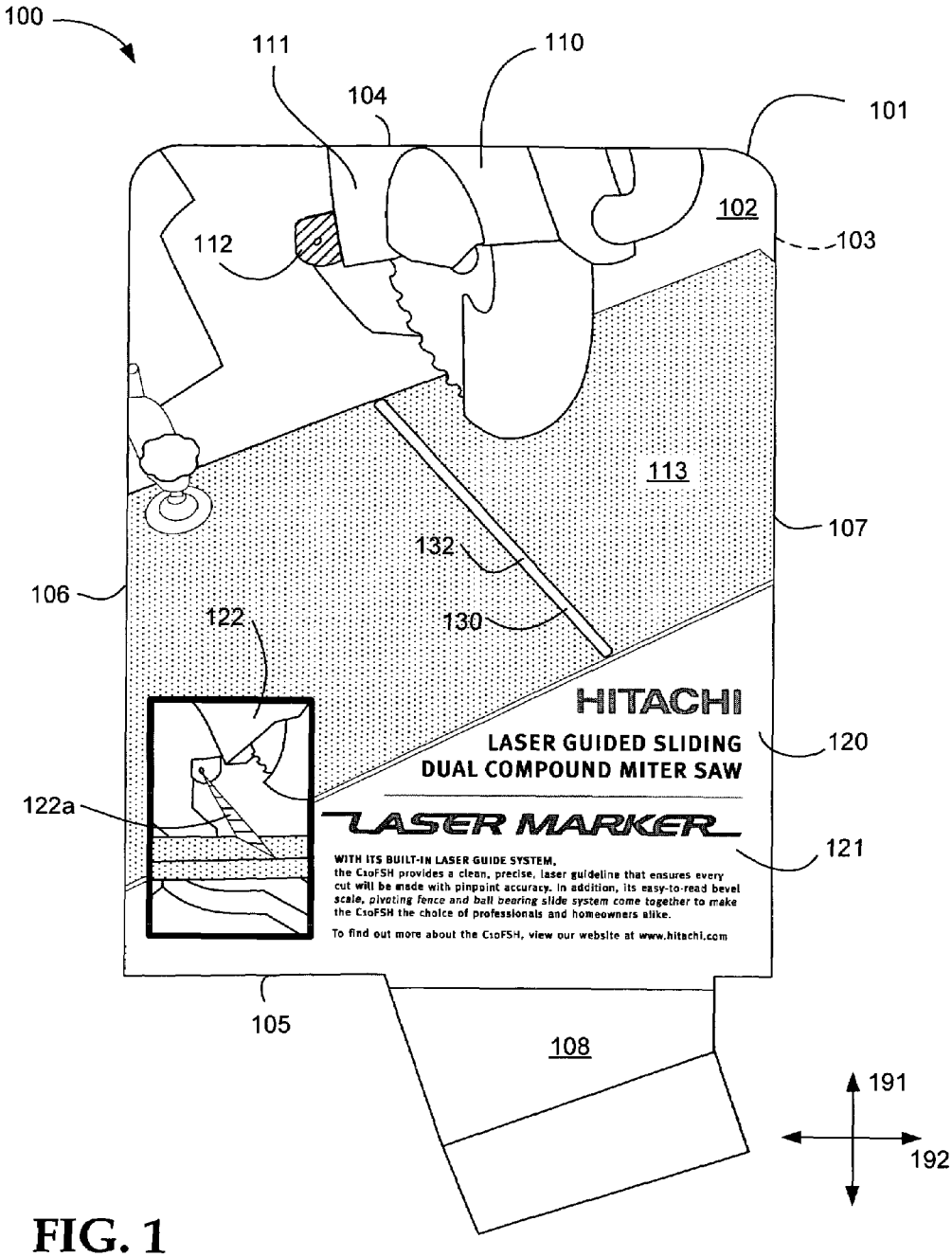
FIG. 1 depicts the front surface of a point-of-purchase display of one embodiment of the present invention. The embodiment depicts a miter saw power tool that includes a laser beam guideline.

The preferred embodiment of the present invention is for a point-of-purchase ("POP") display, or other type of display, that is intended to convey to a potential consumer the idea of an illuminated item. A POP display of the present invention comprises a display board, one or more graphical elements disposed on the display board, one or more openings or windows through the display board, and one or more optical waveguides mounted on the display board, which provide illumination through the openings in the display board. While the embodiments described herein refer to a POP display, it will be readily understood that the present invention can also be used with other types of advertisements or displays, such as window front displays or billboards.

The display board can be any display medium that is suitable for a POP display. The display board preferably is capable of displaying a picture of a product, or an advertisement for a product. The display board may be constructed of any suitable material, such as styrene, acrylic, sheet metal, paperboard, or any combination thereof. Preferably, the display board is a styrene substrate, which has been die cut and formed into a generally self-supporting shape.

Preferably, the display board has at least one surface on which is disposed one or more graphical elements. The graphical elements may be printed on, adhered to, or otherwise displayed on one or more surfaces of the display board. Preferably, at least one of the graphical elements disposed on the display board is a picture or representation of the object being advertised. The board may comprise one primary graphical element such as a picture of the object, and one or more secondary graphical elements that may be related or unrelated to the primary graphic, and contribute to the overall POP display. In this context, the primary graphical element might be, for example: a photograph, an illustration, or other graphical representation of the object, a trademark or logo, a product name, or textual or symbolic characters. Preferably, the primary graphical element depicts the entire object, or a portion thereof, and contains sufficient detail to clearly identify the object and to communicate the object's function to the potential consumer. It is also preferred for the primary graphical element to illustrate the object in a context in which the consumer would recognize the intended use of the object. More preferably, the primary graphical element comprises a picture of an object that depicts an illuminated element that is either a radiant source of light or an illuminated surface, such as a laser beam, a projected laser beam such as a laser beam guideline, a headlight, light-emitting diodes, and the like. While the use of a graphical representation of the product that is the subject matter of the POP display is preferred, it is also envisioned that the primary and other graphical elements may comprise text, trademarks, brand- or other product-identifying insignia, in addition to or in lieu of images of the devices being advertised.

One useful feature of the present invention is the depiction of a light emitting feature or illuminated surface in relation to the object being advertised. For example, a preferred embodiment of the present invention is a POP display for a laser tool, a laser tool being any tool having a laser, such as a miter saw that uses a laser to project a cutting line, a level that projects a level line, or simply a laser. For the purposes of further explaining the invention, a preferred embodiment that will be discussed is a POP display for a miter-saw power tool that uses a projected laser beam guideline to assist the user in making a precise cut. The function of the tool is that a laser is used to project a guideline onto a workpiece at a location corresponding to where the miter saw blade will make its cut, thus assisting the user in placing a precise cut. When advertising such a device, it is preferable to make the laser beam guideline feature of the tool a prominent element of the display. The present invention does this by illuminating at least a portion of the display in a fashion that corresponds to how a user would see the projected laser beam guideline when using the tool. A laser beam is typically not visible until it is projected onto and reflected off of a surface, therefore the preferred embodiment represents a projected laser beam, not the beam itself. However, a display could be just as effective by depicting a laser beam, in addition to or instead of a projected beam.

An example of a POP display is shown in FIG. 1. POP display 100 comprises a display board 101 that has a front surface 102 and a rear surface 103. The display board 101 is bound by a top edge 104, a bottom edge 105, and two side edges (106, 107). The display board 101 has a longitudinal axis 191 and a transverse axis 192. While the display board 101 is shown as being flat and rectangular, other shapes and surface contours may be used.

The display board also preferably has a display mount 108 disposed on the bottom edge 105, for mounting the display board 101 to one or more external surfaces, such as a store shelf. It is also envisioned that the display mount 108 could be disposed on any edge of the display board 101, as long as the display mount is effective in securing the POP display 100. In the shown embodiment, the display mount 108 is a folded base (see FIG. 2), but may instead comprise a hook, strap, hook-and-loop fastener, adhesive strip, or any other type of display mount, as are well known in the art. The display mount 108 may also be omitted from the device if it is not necessary.

A series of graphical elements are disposed on the front surface 102. The primary graphical element 110, comprises a picture of a power tool (a miter saw 111) having a laser beam guideline tool 112. The miter saw 111, with the laser beam guideline tool 112, are shown as they would be used by a consumer. To help illustrate how the miter saw 111 would be used, a workpiece 113 is incorporated into the primary graphical element 110. Here, the workpiece 113 is a piece of wood that is in position to be cut by the miter saw 111. To further illustrate how the miter saw 111 would be used, the present invention includes an opening or cutout 130 depicting where the laser beam guideline is projected onto the workpiece 113. In the present embodiment, the projected laser beam guideline is the illuminated element of the graphical element. The preferred embodiment of the POP display 100 also contains secondary graphical elements 120, 121, 122 which help to communicate the consumer the use and benefits of the miter saw 111 with the laser beam guideline tool 112. In the preferred embodiment, graphical element 120 is a textual graphical element that identifies the tool as a "Laser Guided Sliding Dual Compound Miter Saw" and identifies the manufacturer of the tool. Graphical element 121 is another textual graphical element that identifies the benefits of the tool to the consumer, and additional information about the tool, such as its model number. Graphical element 122 is an illustration of the tool in a slightly different angle showing the projected laser **122*a*** and the beam itself using conventional graphical techniques, such as simple ink printing, to further demonstrate the function of the tool.

As noted before, the POP display 100 also incorporates a depiction of where the laser beam guideline tool 112 would project a laser beam guideline onto a workpiece 113 (i.e., just below the saw blade) by placing a cutout 130 through the display board 101 at this location. The laser beam guideline cutout 130 is illuminated by placing an optical waveguide 132 adjacent to the back surface 103, where it can collect ambient, natural, or artificial light. An illuminating edge 134 of optical waveguide 132 is also positioned adjacent to or inside the cutout 130. The optical waveguide 132 thus emits light through the cutout 130 in a manner simulating the appearance of the projected laser guideline. While the preferred embodiment uses a waveguide or series of waveguides to represent a projected laser beam, in another embodiment the invention provides a display that uses a waveguide to represent items that are not normally lit, but are lit in the display to visually enhance the display. For example, the waveguides could be positioned to form letters, figures, or other images.

Figure 2:
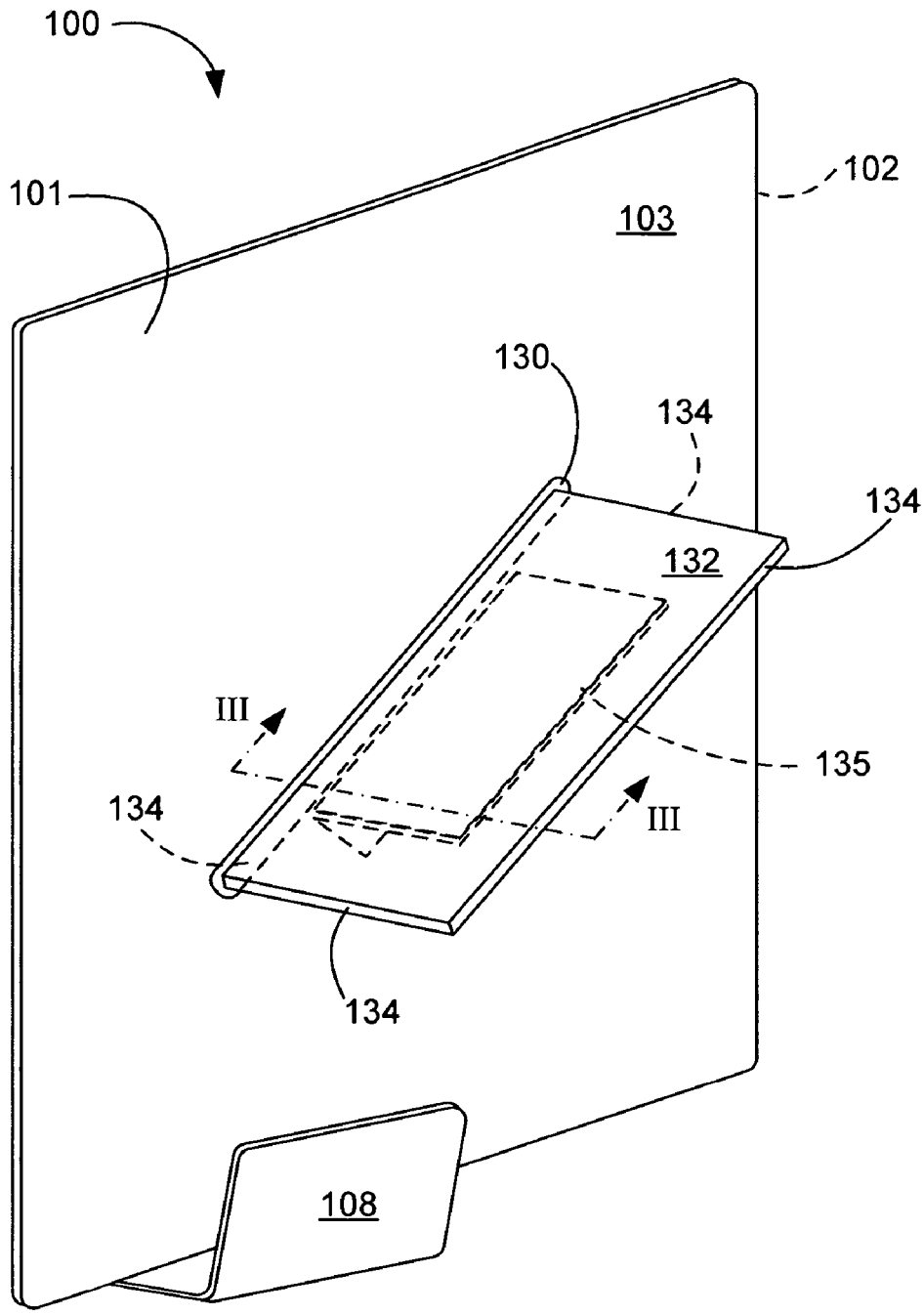
FIG. 2 is a perspective drawing of the rear side of the point-of-purchase display of FIG. 1.
Figure 3:
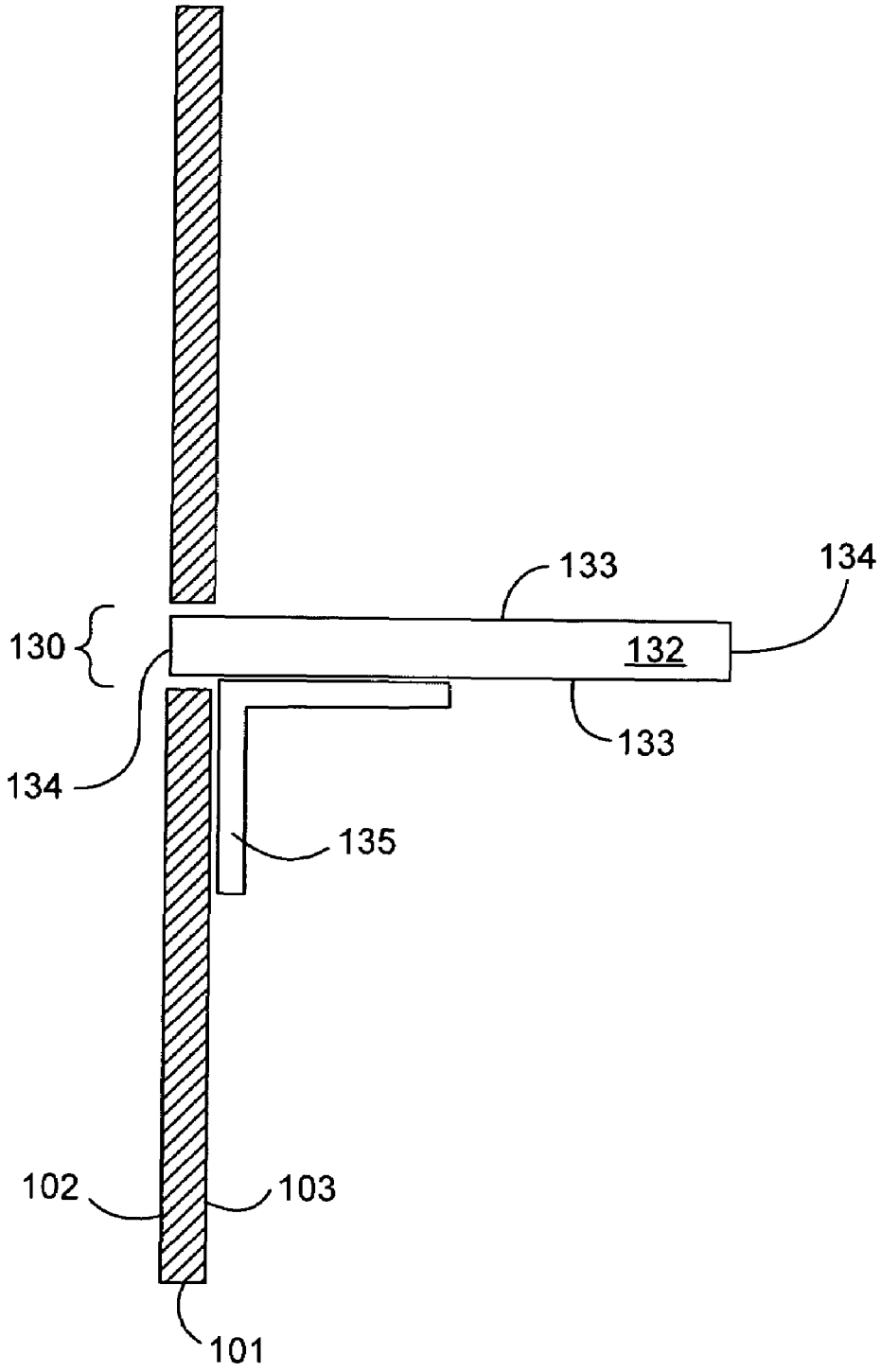
FIG. 3 is a sectional view detailing how the illuminating device is attached and oriented in relation to the point-of-purchase display of FIG. 1.

Referring now to FIGS. 2 and 3, the optical waveguide 132 has two translucent sides 133, and one or more illuminating edges 134. The waveguide generally operates by capturing ambient, natural, or artificial light through the translucent sides 133 (FIG. 3). The captured light is then reflected internally by the sides 133, concentrated, and transmitted externally primarily through the illuminating edges 134, giving an intense visual effect similar to electrically powered illumination sources like neon lighting. At least one of the illuminating edges 134 is aligned adjacent to or inside the cutout 130 so that the illuminated edge 134 emits light through the cutout 130 and is visible from the front surface 102. Thus, in the shown embodiment, the illuminated edge 134, emits light that is similar in both character and location to the light that would be emitted by a laser beam guideline tool.

The optical waveguide 132 may be made from any material that collects ambient light and retransmits it to the cutout 130. The waveguide may comprise, for example, plastic, glass, or any generally transparent material. Examples of materials that may be employed to fabricate a waveguide include, for example, acrylic, polycarbonate, and silicone. Examples of a suitable waveguide material are acrylic or polycarbonate sheets, such as those commercially available under the trade names: ACRYLITE, manufactured by Cyro Industries of Rockaway, N.J.; PLEXIGLASS, manufactured by Rohm and Haas of Philadelphia, Pa.; LUCITE, manufactured by DuPont of Wilmington, Del.; and LEXAN, manufactured by General Electric Plastics of New York. It is preferable for the waveguide material to have a tint that is appropriate for the display, such as red or orange in the case of a red laser beam guideline. The waveguide also may be tinted by coating or covering it with a colored substance along one or more illuminating edges 134. For example in one embodiment, the waveguide 132 may comprise a yellow material and a portion of the illuminating edge 134 adjacent to the cutout 130 may be covered by a green-colored cellophane (not shown) to provide an appearance of a multi-colored beam of light.

The sides 133 of the waveguide 132 may simply comprise the surface of the material, or they may be treated to enhance the waveguide's ability to capture and reflect light internally. For example, the sides 133 may be chemically or physically treated to change their properties, or may comprise additional layers of material that are disposed on the waveguide 132. The reflective sides 133 may be selected for their translucent properties, which affect the ability of the waveguide to collect light; as well as for their internal reflective properties, which affect the ability of the waveguide to concentrate light within the waveguide material. The illuminating edges 134 may be smooth, or may be roughened in order to increase the diffusion of light emitted. Some or portions of the illuminating edges 134 also may be covered to prevent light from passing therethrough.

The size and shape of the optical waveguide 132 may be selected based on desired illumination qualities and other practical or design factors. For instance, the surface area of the reflective sides of the waveguide material is believed to be approximately proportional to the amount of light which may be captured by the waveguide and a larger surface area can be expected to provide increased illumination. As such, one of ordinary skill in the art can determine the overall surface area needed based on the intensity of light in the retail area, and the desired illumination intensity of the edge 134. The thickness of the optical waveguide 132 may likewise be selected based on the waveguide material's ability to capture and reflect ambient light, and based on its size relative to the illuminated feature of the display. Preferably, the optical waveguide 132 has a uniform thickness in order to provide uniform internal reflection properties throughout the waveguide. The particular size and shape of the waveguide 132 for a particular application can be readily determined by those of ordinary skill in the art without undue experimentation.

The optical waveguide 132 generally provides the most intense illumination along its illuminating edges 134. Therefore, it is preferable to dispose the optical waveguide 132 such that the illuminating edge 134 is generally parallel to the front surface 102. Referring to FIG. 3, optical waveguide 132 is preferably behind and adjacent to the cutout 130, and more preferably extends into the cutout 130. Preferably, the illuminating edge 134 is generally coplanar with the front surface 102. However, due to varying tolerances that are inherent in manufacturing processes, the illuminating device may extend past the plane of the front surface 102, or it may not extend all the way to the front surface 102 and the display 100 will still convey the desired effect. It may also be desirable to have a portion of the waveguide 132 actually extend through the cutout 130 to provide additional visual affects. The waveguide 132 may also be positioned to be visible through a transparent portion of the display, instead of using a cutout 130.

The optical waveguide 132 is secured to the display board 101, preferably to the back surface 130, by a waveguide mount 135. The waveguide mount 135 may economically be constructed of the same material as the display board 101, however, it may be made of any material suitable for such a purpose, including, styrene, acrylic, epoxy, adhesives, sheet metal, paperboard, or any combination thereof. A preferred embodiment of the invention has a waveguide mount 135 that is an angled piece of styrene that is adhesively bonded to the back surface 103 of the display board 101. The optical waveguide 132 is in turn adhesively bonded to the waveguide mount 135. It is also envisioned that the waveguide mount 135 may be cohesively bonded to the either the display board 101 or the optical waveguide 132 or both, so long as the materials selected will accommodate cohesive bonding. Any other attachment method, such as mechanical fasteners and the like, also may be used.

In the preferred embodiment of FIGS. 1-3, the display board 101 is die cut from a sheet of styrene, and part of the pattern conveniently includes the display mount 108 as shown in FIG. 1. After die cutting the display board 101, the display mount 108 can then be formed and/or folded to the desired shape so as to facilitate mounting the display board. The display also may mount on a shelf, hang from a shelf, ceiling, or other structure, stand on a floor or other surface, or otherwise be configured to provide a display for the product being sold. The display board may be designed to be self-supporting, or may rely on other means to affix it such as an adhesive mount, a hook mount, a hook-and-loop type fastener, arms, legs or other brackets useful to support the display board in the desired location.

For specific applications, it may be desirable to position the waveguide 132 in a manner to maximize its ability to collect light, and the graphical elements on the front can be rearranged so as not to lose the desired look. To do this, the translucent reflective sides 133 of the waveguide 132 may be oriented so that they are orthogonal to the expected location of ambient light. For example, in window displays, the light often comes from directly above the display, and so the waveguide 132 and graphical elements may optimally be oriented to take the greatest advantage of this ambient light source. While the present invention does require some form of light to deliver the desired effect of depicting an illuminated item, it should be restated that the present invention does not need a dedicated light source to function and therefore provides a distinct advantage over the other displays.

The foregoing detailed description is provided to describe one embodiment of the invention in detail, and is not intended to limit the invention as claimed herein. Those skilled in the art will appreciate that various modifications may be made to the invention without departing significantly from the spirit and scope thereof. For example, the present invention may be used to illuminate other types of graphics, such as corporate or product logos and other laser beam products. Furthermore, to the extent that embodiments of the claimed invention may vary due to manufacturing tolerances or other practical considerations, those variations are intended to be included within the literal scope of the claims.

What is claimed is:

1. A display comprising:

a display board comprising a front surface and a rear surface;

a graphical element disposed on the front surface, wherein the graphical element comprises an illuminated element;

one or more openings in the display board that pass from the front surface to the rear surface; and an optical waveguide positioned to be visible through the one or more openings, the optical waveguide being capable of redirecting ambient light from a source external to the display to provide an illuminated pattern, corresponding to the illuminated element.

2. The display of claim 1 wherein the illuminated element represents a projected laser beam.

3. The display of claim 1 wherein the illuminated element represents a laser beam.

4. The display of claim 1 wherein a substantial portion of the waveguide extends beyond the rear surface.

5. The display of claim 1 wherein at least a portion of the waveguide extends from the rear surface to the front surface and is approximately flush with the front surface.

6. The display of claim 1 wherein the waveguide is illuminated using natural or ambient light.

7. The display of claim 1 wherein the waveguide is an acrylic or polycarbonate sheet.

8. The display of claim 1 wherein the illuminated pattern corresponds to a size and location of the illuminated element.

9. The display of claim 1 wherein the device depicted by the graphical element is a power tool.

10. A display comprising:

a display board comprising a front surface and a rear surface;

a graphical element disposed on the front surface, wherein the graphical element represents a laser tool;

an opening in the display board that passes from the front surface to the rear surface;

an optical waveguide, having at least one illuminating edge, wherein the optical waveguide is positioned so that the at least one illuminating edge is visible through the opening; and wherein the optical waveguide is further adapted to receive ambient light from a source external to the display, and emit the ambient light through the at least one illuminating edge to represent a projected laser beam, a laser beam, or a light source associated with a power tool.

* * * * *